US006193170B1

(12) United States Patent
Fitzgerald

(10) Patent No.: US 6,193,170 B1
(45) Date of Patent: Feb. 27, 2001

(54) READY-ACCESS FIRE-FIGHTING NOZZLE AND METHOD

(76) Inventor: John J. Fitzgerald, 4326 Birch Dr., Mesquite, TX (US) 75150

( * ) Notice: Subject to any disclaimer, the term of this patent is extended or adjusted under 35 U.S.C. 154(b) by 0 days.

(21) Appl. No.: 09/479,131

(22) Filed: Jan. 7, 2000

(51) Int. Cl.[7] ..... A62C 31/22
(52) U.S. Cl. ..... 239/271; 239/276
(58) Field of Search ..... 239/271, 276

(56) References Cited

U.S. PATENT DOCUMENTS

| | | | | |
|---|---|---|---|---|
| 551,527 | * | 12/1895 | Cunningham | 239/271 |
| 2,224,010 | * | 12/1940 | Barber | 239/271 |
| 2,246,797 | * | 6/1941 | Geddes | 239/271 |
| 2,413,083 | * | 12/1946 | Snowden et al. | 239/271 |
| 4,403,661 | | 9/1983 | Tokar | 169/38 |
| 4,485,877 | | 12/1984 | McMillan et al. | 169/48 |
| 4,676,319 | * | 6/1987 | Cuthbertson | 239/271 X |
| 4,802,535 | * | 2/1989 | Bakke | 239/271 X |
| 4,828,182 | | 5/1989 | Haruch | 239/432 |
| 5,211,245 | | 5/1993 | Relyea et al. | 169/24 |
| 5,301,756 | | 4/1994 | Relyea et al. | 169/24 |
| 5,392,993 | | 2/1995 | Fischer | 239/522 |
| 5,505,383 | | 4/1996 | Fischer | 239/518 |
| 5,839,664 | | 11/1998 | Relyea | 239/271 |
| 5,857,629 | | 1/1999 | Miller et al. | 239/252 |
| 5,887,801 | | 3/1999 | Stevens | 239/590 |
| 5,947,387 | | 9/1999 | Zink et al. | 239/227 |

* cited by examiner

*Primary Examiner*—Lesley D. Morris
(74) *Attorney, Agent, or Firm*—Joan I. Norek; The Law Office of Joan I. Norek

(57) ABSTRACT

A fire-fighting hose nozzle or line nozzle, that is, a nozzle used to discharge fluid spray during fire-fighting operations, is accoutered for high water-pressure spraying of water or other fire fighting fluid by professional firefighters. Such a high-pressure can, for instance, put about 200 pounds (p.s.i.) or more pressure on a nozzle tip. The nozzle has a long, slender body member with a weighted and pointed tip, a discharge orifice at a position rearward of the pointed tip, and at least one transverse member, and in embodiments a plurality of transverse members. The transverse member most proximate to the proximal end of the body member functions both as a set of handles and as a stabilizing member. A second transverse member functions as a stabilizing member. The orifice is a slot angle-cut forward or backward from its mid-section which produces a wide and high fan-shaped spray in either the forward or backward direction. A set of such nozzles might include one nozzle for forward discharge and one for backward discharge. A method of using such a nozzle includes inserting the nozzle at least partially through an obstruction opening and discharging fluid backward, and includes lowering the nozzle down the side of a building to an opening, with the discharge orifice facing inward, and discharging fluid into the opening.

19 Claims, 3 Drawing Sheets

READY-ACCESS FIRE-FIGHTING NOZZLE AND METHOD

BACKGROUND OF THE INVENTION

Professional fire-fighters routinely need or desire almost immediate access to interior regions of burning structures or other materials. The discharge of fire-fighting fluid(s) to the exterior or otherwise readily accessible surfaces may be insufficient to so much as mitigate a fire raging on nearby, but obstructed or otherwise inaccessible, surfaces. Delays in reaching critical areas often allow an otherwise controllable fire to spread and/or intensify exponentially, increasing the property loss and/or risk to human life. An insignificant fire can develop into a conflagration while fire-fighters wait for ancillary equipment.

Surfaces or regions that are routinely inaccessible to professional fire-fighters equipped with conventional primary or basic equipment (often as would be the fire-fighters deployed from the first engine that arrives at the site) include, without limitation, (a) obstructed interiors and/or regions, for instance those behind barred doors, behind barred windows, behind walls, roof structures or other structural barriers without sufficient entry routes, below or beneath docks, rail trestles and the like, within automotive vehicles, railway cars, aircraft, storage tanks and the like, (b) surfaces and regions beyond the reach of conventional equipment discharges, for instance areas not within a direct line from the discharge source, and (c) regions of high risk to a fire-fighter's safety. In some or even many instances an inaccessible area could be considered obstructed and/or beyond reach and/or a high-risk zone, and in such instances the selection of categorization is generally of no significance regarding the present invention.

A means for providing quick access to inaccessible regions is of limited or no value unless such means can also provide effective fire-fighting discharges in those regions under rigorous conditions.

A means for providing quick access to inaccessible regions is of limited or no value unless such means can be readily and reliably deployed under rigorous conditions.

A means for providing quick access to inaccessible regions is of limited or no value unless such means is sufficiently versatile so that it is not itself a specialty or ancillary equipment not available to the first fire-fighters on the scene.

A means for providing quick access to inaccessible regions is of limited or no value unless it can be effectively used in both a hands-on mode and in a remote (hands-off) mode.

A means for providing quick access to inaccessible regions is of limited or no value unless such means can be readily and reliably deployed in combination with conventional auxiliary equipment and conventional fire-fighting water or fluid sources.

Unlike unrestricted manipulation of conventional fire hoses and nozzles, the ability to manipulate and/or change the discharge direction or reach of a means for providing quick access to inaccessible regions once it is deployed will frequently be limited or non-existent. As mentioned above, there is little or no value unless the means can readily and reliably provide effective fire-fighting discharges in those regions. That in turn depends on whether the means provides a sufficient spray pattern without post-deployment manipulation or adjustment, and whether the means resists post-deployment whipping and other high-pressure static instabilities, particularly when deployed in the remote or hands-off mode.

Varied fluid spray patterns are known for less rigorous applications that can tolerate the concomitant structural complexities of these devices. For instance, U.S. Pat. No. 5,947,387, issued Sep. 7, 1999, inventor Zink et al., describes a nozzle with three-dimensional spray pattern for internal cleaning wherein the divergent spray patterns are provided by a rotating water-jet. U.S. Pat. No. 5,505,383, issued Apr. 9, 1996, inventor Fischer, describes a fixed sprinkler head for discharging fine droplets over perhaps a sixteen-foot range, with a lead-in narrow neck that could easily be plugged or clogged by small foreign objects and with vertical side fins. U.S. Pat. No. 5,392,993, issued Feb. 28, 1995, inventor Fischer, describes a fire-protection fixed sprinkler head having a diffuser element via a deflector loading screw to provide a wide spray pattern mist and vertical side fins. U.S. Pat. No. 4,828,182, issued May 9, 1989, inventor Haruch, describes a nozzle employing compressed air, a complicated series of valves and a deflector flange to obtain a cooling mist having a relatively flat, wide spray pattern for cooling air conditioning systems and the like, not for fire-fighting purposes. U.S. Pat. No. 4,403,661, issued Sep. 13, 1983, inventor Tokar, describes a fixed sprinkler head with pair of side fins plus directional orifices/deflector producing a conical spray pattern.

Mechanical means to resist high water-pressure instabilities of a fire-fighting hose and nozzle are known from U.S. Pat. No. 5,887,801, issued Mar. 30, 1999, inventor Stevens, which describes a nozzle add-on (added upstream of a tip-discharge nozzle) which is comprised of a complex series of chambers to control high-pressure spray recoil. That combination does not provide any means for quick access to inaccessible regions.

Means to break down barriers in combination with a fire-fighting nozzle are known. For instance, U.S. Pat. No. 5,857,629, issued Jan. 12, 1999, inventor Miller et al., describes a conical penetration nozzle having thirty-two serially and concentrically arranged ports, including ports that discharge in a backward direction, the combination of port arrangement and nozzle rotation (rotational couplings and thrust-producing nozzle means) stabilize the nozzle against whipping. The nozzle assembly can be launched or otherwise delivered to a target. U.S. Pat. No. 5,839,664, issued Nov. 24, 1998, inventor Relyea, U.S. Pat. No. 5,301,756, issued Apr. 12, 1994, inventor Relyea et al., and U.S. Pat. No. 5,211,245, issued May 18, 1993, inventor Relyea et al., each describe a piercing nozzle for fire-fighting, operable from an vehicle-mounted aerial boom, having a pointed, and possibly hardened steel, tip and discharge orifices upstream of tip. U.S. Pat. No. 4,485,877, issued Dec. 4, 1984, inventor McMillan et al., describes a conical penetration nozzle primarily for fire control behind barriers or within piles with opposed orifices upstream of conical tip providing sideways curtains of spray. There are of course instances when a nozzle that can be used to attack and thereby remove a barrier, even from a vehicle mounted aerial boom, is of value. Nonetheless, it is believed that none of these prior art devices can provide, in a single structure, (a) the effective fire-fighting discharges in inaccessible regions, (b) the ease and reliably of deployment, (c) the versatility, (e) the hands-on mode and the remote or hands-off mode, (f) the ready and reliable deployment in combination with conventional auxiliary equipment and conventional fire-fighting water or fluid sources, (g) the a sufficient spray pattern without post-deployment manipulation or adjustment, and (h) the resistance to post-deployment whipping and other high-pressure instabilities, which are all provided by the present invention, as described below.

BRIEF SUMMARY OF THE INVENTION

The present invention is a fire-fighting hose nozzle or line nozzle, that is, a nozzle used to discharge fluid spray during fire-fighting operations. The nozzle is accoutered for high water-pressure spraying of water or other fire fighting fluid by professional firefighters. Such a high-pressure can, for instance, put about 200 pounds (p.s.i.) or more pressure on a nozzle tip. The nozzle has a long, slender body member with a weighted and pointed tip, a discharge orifice at a position rearward of the pointed tip, and at least one transverse member. The transverse member most proximate to the proximal end of the body member functions both as a set of handles and as a stabilizing member. A second transverse member functions as a stabilizing member. The orifice is a slot angle-cut forward or backward from its mid-section which produces a wide and high fan-shaped spray in either the forward or backward direction. The present invention includes a set of such nozzles, and a method of using such a nozzle.

DETAILED DESCRIPTION OF THE INVENTION

Figure 1:
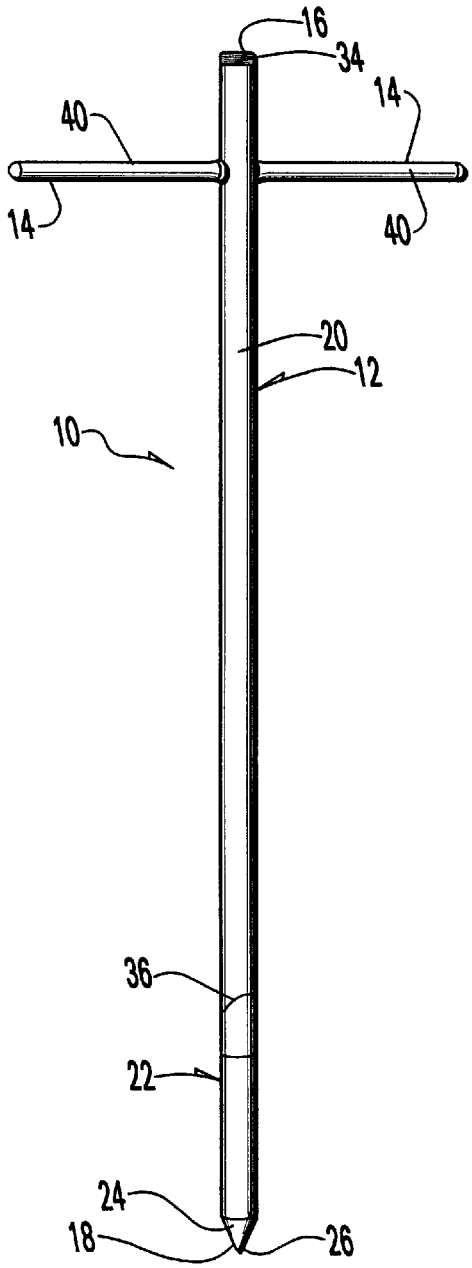
FIG. 1 is a top but slightly-turned plan view of a nozzle of the invention.
Figure 2:
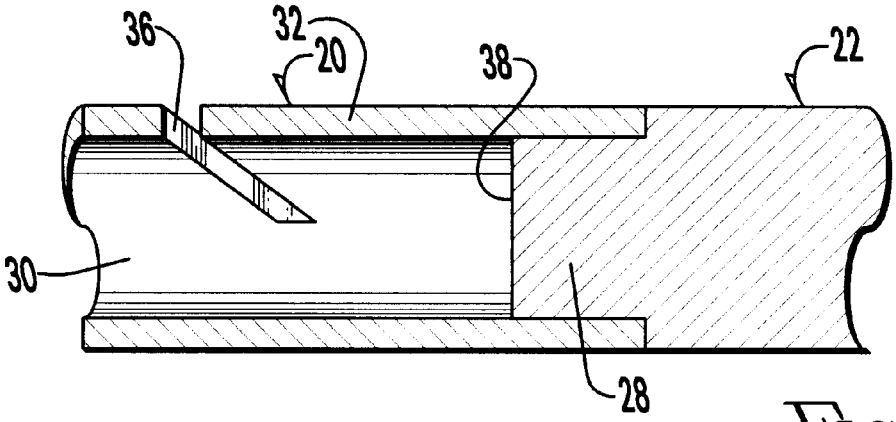
FIG. 2 is a diagrammatical cut-away view of a section of the nozzle of FIG. 1.

As shown in FIG. 1 and FIG. 2, and in preferred embodiment, a fire-fighting fluid-discharge nozzle, designated generally by the reverence number 10, includes an elongate, relatively slender body member 12 and a cross or transverse member 14. The body member 12 has a proximal end 16 and a distal end 18. In use the nozzle 10 is typically disposed with the distal end 18 of the body member 12 towards (or within) the fire area and the proximal end 16 of the body member 12 away from (or outside of) the fire area. In other words, the distal end 18 of the body member 12 is the fire-extinguishing, fluid-outlet and/or working end of the nozzle 10 and the proximal end 16 of the body member 12 is the operator-handling, hose-connection and/or fluid-inlet end of the nozzle 10. The working and handling of the nozzle 10 is not, however, wholly conventional, as will be discussed below.

The body member 12 is elongate and slender, and almost five feet in overall length. The body member 12 is comprised of an approximately four-foot hollow or bored element 20 extending from the proximal end 16 of the body member 12 forward, and a non-bored solid element or insertion tip 22. The insertion tip 22 is about one foot in overall length (one inch of which length is positioned within the bored element 20), has an exterior length of about eleven inches, and is fabricated of hardened steel. This insertion tip 22 weighs about ten pounds, and the total weight of the nozzle 10 is about twenty-five pounds. The body member 12 has about a one and one-half inch inside diameter (I.D.) and about a two inch outside diameter (O.D.), except for the tapered and relatively sharp point 24 at the distal end 18 of the body member 12 (at the free end 26 of the insertion tip 22). The insertion tip 22 has a connection section or end 28 opposite its free end 26 which is about one inch in length and which is machined down to an O.D. of just less than 1.5 inches. The connection end 28 of the insertion tip 22 is fitted snugly and welded within the bore or flow passage 30 of the bored element 20, whereby the bored element 20 and insertion tip 22 are firmly united or coupled. The exterior of the body member 12 is machined to smoothness about this joint. The wall 32 of the bored element 20 has a substantially ring-shaped cross-sectional profile, and has a thickness of about one-fourth inch. The flow passage 30 of the bored element 20 has a diameter of about one and one-half inches and a cross-sectional area (flow area) of about one and seven-tenths square inches.

The insertion tip 22 at the distal end 18 of the body member 12 is, as mentioned, a solid and heavy element in contrast to the otherwise hollow bored element 20, and preferably is formed of hardened steel or the like. In use the insertion tip 22, and in particular the point 24, is at the vanguard or forefront of typical access-gaining manipulations of the nozzle 10, and therefore preferably is both sufficiently sturdy, and the point 24 is sufficiently narrow or constricted and pointed, or tapered, to withstand and facilitate these manipulations. The point 24 is about three inches long, constituting about one-fourth of the length of the insertion tip 22 and a slightly higher proportion of the tip's exterior length), and its tapering sides incline sharply in to an apex at an angle of about 20° from the longitudinal line of the body member 12. The insertion tip 22 is not a penetration or piercing tip in the sense of being used to break through obstructions as this terminology is used to describe prior art nozzles. The insertion tip 22 would not withstand an attempt to break through a common two inch board without bending because of its slender profile, despite its solid, hardened-steel fabrication. Instead the solid and hardened fabrication is a feature that facilitates insertion and contributes to the stability of the nozzle 10, which is discussed in detail below.

A mechanical coupling element at the proximal end 16 of the body member 12 provides the mechanism for connection of the nozzle 10 to a mating hose or other fluid line of a fluid-transmission system (not shown). The mechanical coupling element of the nozzle 10 is a male threading 34, which in conventional fashion can be mated to a hose or other device that has a complementary female threading. Normally this threading should conform to the standards for fire department standard pipe thread or hose-pipe thread.

The nozzle 10 has a single discharge opening or orifice 36, located on the body member 12 about fifteen inches back from the apex of the point 24. The orifice 36 is thus positioned somewhat upstream or rearward of the butt-end wall 38 of the connection end 28 of the insertion tip 22, about a two to three inch distance depending upon the point on the orifice 36 from which the distance is measured. The flow passage 30 therefore extends from the intake area or proximal end 16 of the body member 12 to the closed end or butt end 38, somewhat past the orifice 36. The orifice 36 is along the flow passage 30, and close or near to the closed end of the flow passage 30 but not at the absolute end of the flow passage 30. The orifice 36 is a slot or slit or slotted opening which lies in along a plane (referred to herein as the "slit plane") which intersects a normal plane (a plane in which lie a circular array of lines disposed normal to the outside surface of the bored element 20) at a 45° angle. The orifice 36 extends from side to side of the bored element 20, running from a point on one side of the bored element 20 rearward (in the direction of the proximal end 16 of the body member 12), and then back forward (in the direction of the distal end 18 of the body member 12) to the point directly opposite on the other side of the bored element 20. As seen in a cross-sectional cut, that is, an imaginary cut through the bored element 20 from the bottom side up to both opposed ends of the orifice slit, which cut would sever the body member 12 at the orifice 36, the orifice 36 encompasses or rounds about fifty percent of the circumference of the bored element 20. The slit of the orifice 36, in other words, is along the slit plane from the topside of the bored element 20 down to the extend at which it meets a plane in which the longitudinal axis of the body member 12 lies. The orifice 36 of nozzle 10 is referred to herein as a forward-cut slot because is runs forward (toward the distal end 18 of the body member 12) from its center-point. The slit of the orifice 36 is about one-fourth inch wide and about three to four inches long (measured along its extent from one end to the other). This nozzle 10, due to its forward-cut slot, will discharge a backward spray of fluid.

The transverse member 14 is a stabilization and nozzle-manipulation member comprised of a pair of opposed co-axial arms 40 extending from opposite sides of the nozzle 10. The arms 40 and orifice 36 define a topside and a bottom side of the nozzle 10, that is, viewing the nozzle 10 with the arms 40 stretching out at the right and left sides, the side of the nozzle 10 on which the orifice 36 is cut (or on which most of the orifice is cut if the cut is not wholly on one side) is the topside, and the opposite side on which there is no orifice is the bottom side. The triangulate disposition of the arms 40 with respect to the orifice 36 is important, and the orifice of a nozzle of the present invention should be substantially disposed on one side of the nozzle (the sides being defined by the arms of the transverse member or members), and at least some efficiencies of the nozzle are diminished in proportion to the degree in which an orifice cut is off-sides.

The arms 40 of the transverse member 14, at the inner ends, are affixed by conventional means to the outside surface of the body member 12. The transverse member 14 does not penetrate into or through the body member 12 because such a penetration would create an unnecessary and detrimental obstruction in the flow passage 30, narrowing the flow area. The arms 40 are welded onto the body member 12 at their inner ends. The arms are each about twelve inches in length, and thus each separately provides a sidearm extent which in length equals about twenty percent of the longitudinal length of the nozzle 10. The arms 40 are positioned relatively close to the proximal end, that is, about three or four inches from the inner edge of the male threading 34, or within the first ten or fifteen percent of the overall length of the body member 12. The arms 40 each have about a one inch O.D., and can conveniently be fabricated from non-corrosive piping.

Figure 3:
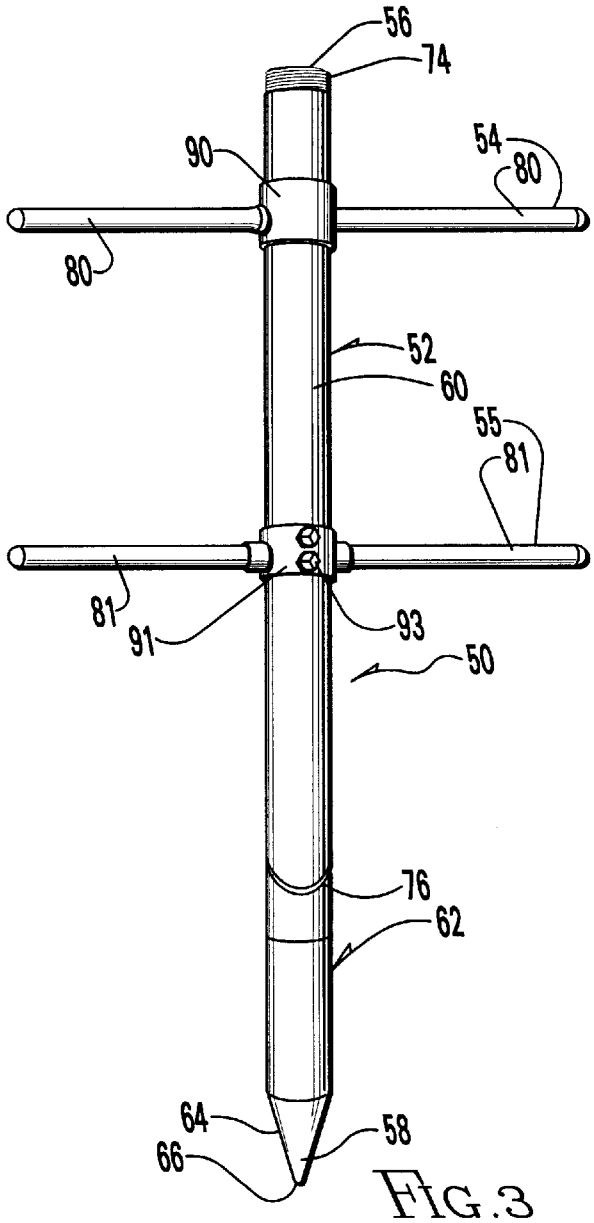
FIG. 3 is a top but slightly-turned plan view of a nozzle of the invention.
Figure 4:
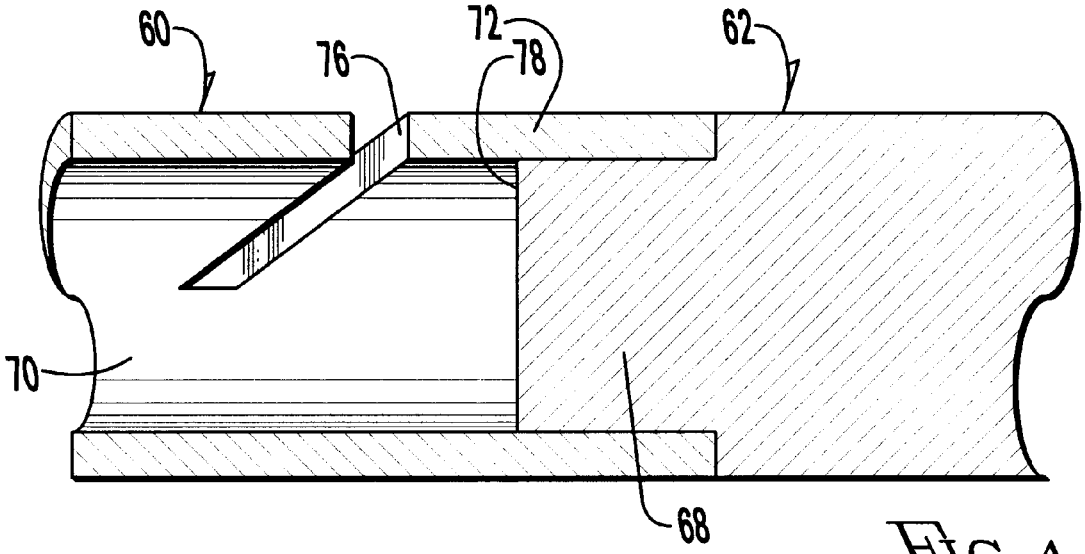
FIG. 4 is a diagrammatical cut-away view of a section of the nozzle of FIG. 3.
Figure 5:
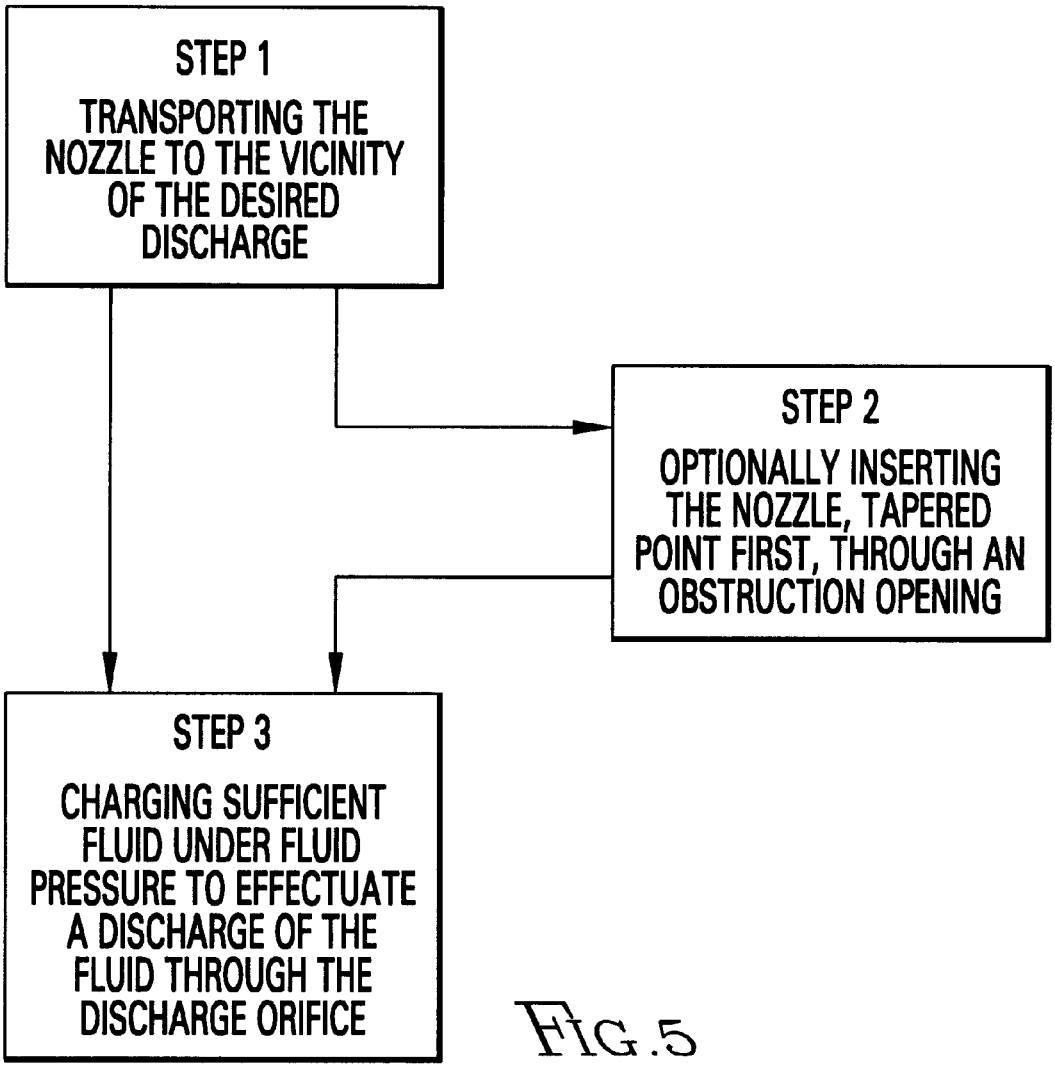
FIG. 5 is a flow diagram of the method of the invention.

As shown in FIG. 3 and FIG. 4, and in a further preferred embodiment, a fire-fighting fluid-discharge nozzle, designated generally by the reverence number 50, includes an elongate, slender body member 52, a first cross or transverse member 54 and a second cross or transverse member 55. The body member 52 has a proximal end 56 and a distal end 58. In use, like the nozzle 10 described above, the distal end 58 of the body member 52 is the fire-extinguishing, fluid-outlet and/or working end of the nozzle 50 and the proximal end 56 of the body member 52 is the operator-handling, hose-connection and/or fluid-inlet end of the nozzle 50.

The body member 52 is elongate and slender, although less slender than nozzle 10 described above, and again about five feet in overall length. The body member 52 is comprised of an approximately four-foot hollow or bored element 60 extending from the proximal end 56 of the body member 52 forward, and a non-bored solid element or insertion tip 62. The insertion tip 62 is about one foot in overall length, one inch of which length is within the bored element 60 providing about an eleven-inch exterior length, and is fabricated of hardened steel. The body member 52 has about a two and one-half inch inside diameter (I.D.) and about a three inch outside diameter (O.D.), except for the tapered and relatively sharp point 64 at the distal end 58 of the body member 52 (at the free end 66 of the insertion tip 62). The insertion tip 62 has a connection section or end 68 opposite its free end 66 which is about one inch in length and which is machined to an O.D. of just less than 2.5 inches. The connection end 68 of the insertion tip 62 is fitted snugly and welded within the bore or flow passage 70 of the bored element 60, whereby the bored element 60 and insertion tip 62 are firmly united or coupled. The exterior of the body member 52 is machined to smoothness about the joint. The wall 72 of the bored element 60 has a substantially ring-shaped cross-sectional profile, and has a thickness of about one-fourth inch. Thus the flow passage 70 of the bored element 60 has a diameter of about two and one-half inches and a cross-sectional area of about four and nine-tenths square inches, or about twice the cross-sectional diameter (and more than double the flow area) of the flow passage 30 of nozzle 10 described above.

The insertion tip 62 at the distal end 58 of the body member 52 is, as mentioned, a solid and heavy element in contrast to the otherwise hollow bored element 60, and preferably is formed of hardened steel or the like. This insertion tip 62 weighs about twenty-six pounds, and the entire weight of the nozzle 50 is about fifty-five pounds. Like the insertion tip 22 of the nozzle 10 described above, this insertion tip 62, in use, is at the vanguard or forefront of typical access-gaining manipulations of the nozzle 50, and therefore preferably is both sufficiently sturdy, and the point 64 is sufficiently pointed (tapered) to withstand and facilitate these manipulations. The point 64 is about four inches long, constituting about one-third of the overall length of the insertion tip 62, and its tapering sides incline sharply in to an apex at an angle of about 20° from the longitudinal line of the body member 52. This insertion tip 62, despite its weight, is also not a penetration or piercing tip in the sense of being used to break through obstructions as this terminology is used to describe prior art nozzles. Instead the solid and hardened fabrication is a feature that facilitates insertion and contributes to the stability of the nozzle 50, which is discussed in detail below.

A mechanical coupling element at the proximal end 56 of the body member 52 provides the mechanism for connection of the nozzle 50 to a mating hose or other fluid line of a fluid-transmission system (not shown). The mechanical coupling element of the nozzle 50 is a male threading 74, which in conventional fashion can be mated to a hose or other device that has a complementary female threading.

The nozzle 50 has a single discharge opening or orifice 76, located on the body member 52 about fifteen inches back from the apex of the point 64. The orifice 76 is thus positioned somewhat upstream or rearward of the butt-end wall 78 of the connection end 68, about a three to four inch distance depending upon the point on the orifice 76 from which the distance is measured. The flow passage 70 therefore extends from the proximal end 56 of the body member 52 to the butt-end wall 78, somewhat passed the orifice 76. The orifice 76 is along the flow passage 70, and close or near to the closed end of the flow passage 70 but not at the absolute end of the flow passage 70. The orifice 76 is a slot or slit or slotted opening as described above regarding the orifice 36 of nozzle 10 except that it is a backward-cut slot because is runs backward (toward the proximal end 56 of the body member 52) from its center-point. The slit of the orifice 76 is about one-fourth inch wide. This nozzle 50, due to its backward-cut slot, will discharge a forward spray of fluid. (Wider orifices are not excluded from broad embodiments of the invention, but would decrease the spread of the fan-shaped spray without any substantial advantage.)

The first transverse member 54 is a stabilization and nozzle-manipulation member comprised of a pair of opposed co-axial arms 80 extending from opposite sides of the nozzle 50. The arms 80 and orifice 76 define a topside and a bottom side of the nozzle 50, that is, viewing the nozzle 50 with the arms 80 stretching out at the right and left sides, the side of the nozzle 50 on which the orifice 76 is cut (or on which most of the orifice is cut if the cut is not wholly on one side) is the topside, and the opposite side on which there is no orifice is the bottom side. The triangulate disposition of the arms 80 with respect to the orifice 76 is important, and the orifice of a nozzle of the present invention should be substantially disposed on one side of the nozzle (the sides being defined by the arms of the transverse member or members), and at least some efficiencies of the nozzle are diminished in proportion to the degree in which an orifice cut is off-sides.

The arms 80 of the first transverse member 54, at the inner ends, are affixed by conventional means to the outside surface of the body member 52. The first transverse member 54 does not penetrate into or through the body member 52 because such a penetration would create an unnecessary and detrimental obstruction in the flow passage 70, narrowing the flow area. The arms 80 are held onto the body member 52 at their inner ends by a conventional collar brace 90. The arms are each about twelve inches in length, and thus each provides a sidearm extent which in length separately equal about twenty percent of the longitudinal length of the nozzle 50. The arms 80 are positioned about five or six inches from the inner edge of the male threading 74, or well within the first ten or fifteen percent of the overall length of the body member 52. The arms 80 each have about a one inch O.D., and can conveniently be fabricated from non-corrosive piping.

The second transverse member 55 is substantially the same as the first transverse member 54 except that its pair of opposed arms 81 are adjustably mounted on the nozzle body member 52 by means of a collar brace 91 that is secured by a plurality of set screws 93 (only forward-facing ones shown) which can be loosened for changing the position of the second transverse member 55 to other locations along the longitudinal length of the body member 52.

The present invention is thus a fluid-discharge nozzle, generally but not necessarily a fire-fighting fluid-discharge nozzle, having an elongate and preferably substantially tubular body member and at least one elongate cross or transverse member affixed thereto. In preferred embodiment, the body member is between about fifteen, or eighteen, and about thirty, or even thirty-five, times as long as it is wide (as determined by outside diameter). The body member is normally longer than the transverse member (measured from free end to free end). Preferably the overall length or extent of the transverse member (measured between the tips of its opposed free ends) is between about thirty, or thirty-five, and about fifty, or sixty, percent of the length of the body member. In more preferred embodiment the overall length or extent of the transverse member (measured between the tips of its opposed free ends) is between about thirty-five and fifty percent of the length of the body member. The transverse member, or the first transverse member in embodiments having a plurality of transverse members, is positioned relatively close to the proximal end of the body member, for instance within the first ten or fifteen percent of the length of the body member. That transverse member functions both as a stabilization means and as a handle for manipulation of the nozzle. The other transverse member(s), which basically are stabilization means, are preferably disposed on the proximal-end half of the body member, and preferably close to, but not at, the body-member's midsection. The body member of the nozzle preferably has a weighted and pointed tip, whereby between about thirty-five, or forty-five, and about sixty-five, or seventy, or even seventy-five, percent of the overall weight of the nozzle is within the distal-end tip. The weighted distal-end tip preferably comprises between about fifteen, or twenty, and about twenty-five, or thirty, percent of the overall length of the body member. The flow passage of the nozzle extends through the body member from the proximal or inlet end up to between about sixty-five, or seventy-five, and eighty-five, or ninety, percent of the overall length of the body member. The flow passage preferably has a diameter of between about one, or one and one-fourth, and about two and three-fourths, or three, inches. The flow passage preferably has a cross-sectional area of between about one, or one and one-half, and about five, or six, square inches. The nozzle has a single discharge opening or orifice, located on the body member, along the flow passage, and relatively close to the far or closed end of the flow passage. The discharge orifice is preferably between about one, or two, and about five, or six, inches rearward (towards the proximal end) of the closed end of the flow passage. The discharge orifice is preferably between about ten, or twelve, and about sixteen, or eighteen, inches back (towards the proximal end) from the apex of the point. The orifice is a slot or slit or slotted opening either cut forward or backward through between about thirty, or thirty-five, and fifty, or fifty-five, percent of the circumferential surface of the body member, as described above. Cuts in excess of fifty percent however cut detract from the integrity of the body member, while cuts approaching, or at, about fifty percent are very preferred. The angle of cut is preferably from about fifteen, or twenty, and forty-five, or forty-eight, degrees from vertical (normal). The discharge orifice slot should substantially or sufficiently lie on one side of the transverse member(s), which side is referred to, and operationally is, the topside of the nozzle. As described above, the direction of the cut determines whether the fluid spray is discharged forward or backward. The transverse members, when there are a plurality of transverse members, should of course substantially lie in the same plane. The arms of the transverse members preferably have between about a three-fourths, or one, and one and one-fourth, or one and one-half, inch O.D. A sufficiently strong mechanical coupling element for connecting the nozzle to a fluid-supply hose or line is provided at the proximal end of the body member.

The nozzle of the present invention permits almost immediate access to interior regions of burning structures or other materials and other normally inaccessible areas, including, without limitation, (a) obstructed interiors and/or regions, for instance those behind barred doors, behind barred windows, behind walls, roof structures or other structural barriers without sufficient entry routes, below or beneath docks, rail trestles and the like, within automotive vehicles, railway cars, aircraft, storage tanks and the like, (b) surfaces and regions beyond the reach of conventional equipment discharges, for instance areas not within a direct line from the discharge source, and (c) regions of high risk to a fire-fighter's safety, and combinations of these circumstances. The pointed tip of the nozzle facilitates its insertion anywhere there is a sufficient opening. Where there is a sufficient opening for the nozzle only up to a transverse member, the insertion up to that point places the discharge orifice within, past the obstruction, for effective fluid discharge within. Where there is a sufficient opening for the entire nozzle (even if the nozzle must be turned sideways or the like, to pass through the transverse member or members), the nozzle can be operated in a remote or hands-off mode, lying on the ground or other surface, and the combination of the transverse member(s) and the weighted tip will resist whipping and other static instabilities caused by the high water-pressure charge and/or other influences. (The hands-off mode of operation can of course be advantageous in circumstances not requiring insertion through or past an obstacle.) The nozzle can also be positioned for use around a corner and discharge to an otherwise inaccessible or high-risk region. The nozzle in particular can be inserted through and discharged beneath docks, rail trestles and the like, within automotive vehicles, railway cars, aircraft, storage tanks and the like, whenever there is a sufficient opening for at least partial insertion (up to a transverse member) or complete insertion (with the transverse member or members). The nozzle can also be used, for instance, by lowering it down the side of a tall building to a target window or other opening, from a higher level (a roof, a higher-level window, etc.), with the discharge orifice facing the building, in which disposition the spray will be discharged into the room through the window. A nozzle with a pair of transverse members, such as nozzle 50 described above, is believed to provide the best static stability in such a vertically-disposed application.

As described above, normally the discharge orifice should always be positioned downstream of all transverse member (s) (closer to the distal end than the transverse member or members). There is believed to be no practical advantage to having a transverse member downstream of the discharge orifice, and such a disposition would have a serious impracticality—the nozzle could not be deployed in a partial insertion mode, with the discharge orifice through or past an obstacle which obstructs the transverse member.

The nozzle of the present invention also provides effective and superior fire-fighting discharges in inaccessible or regions under rigorous conditions, providing either a forward or backward fan-shaped spray which is between about forty, or forty-five, and eighty-five, or possibly even ninety-five, feet in width, and up to about twenty feet high in preferred embodiments.

The nozzle of the present invention provides quick access to inaccessible regions while being readily and reliably deployed under rigorous conditions. Deployment requires nothing other than a conventional connection to the fluid-supply hose or line, placement of the nozzle when operated in a hands-off mode, and a charging of the fluid pressure to the nozzle. There are no movable parts to be set or adjusted in the field, or which could malfunction in the field. (An adjustable transverse member is envisioned as normally being set to the user's preference beforehand.) In addition, foreign matter in the fluid supply is unlikely to clog the nozzle because it has a clear and wide flow passage without narrowing necks, valves or the like, and closed end of the flow passage proximate the discharge orifice should create sufficient internal turbulence so that no foreign matter lodges at the orifice. Further, a nozzle such as nozzle 10 described above can readily be lifted and carried about by the transverse member by a single fire-fighter, and heavier embodiments require no more than two fire-fighters.

The nozzle of the present invention, which can be used in both a hands-on and a hands-off mode, and which can be used both for discharges on external, or accessible, and internal, or inaccessible, structures, is sufficiently versatile so that it is not itself a specialty or ancillary equipment not available to the first fire-fighters on the scene. In addition, its static stability, namely its resistance to post-deployment whipping and other high-pressure static instabilities, is extremely advantageous when the nozzle deployed in the remote or hands-off mode, and it is also extremely advantageous when the nozzle is deployed in a hands-on mode. When one or more fire-fighters firmly grip the transverse member, whipping is efficiently controlled.

The nozzle of the present invention is in all respects deployable in combination with conventional auxiliary equipment and conventional fire-fighting water or fluid sources.

The present invention in broad embodiment is a fluid-discharge nozzle comprising an elongate body member having a proximal and distal end, at least one elongate transverse member affixed to the body member and extending normal from the body member sideways, a flow passage within the body member extending from the proximal end to a closed end rearward of the distal end, a discharge orifice positioned on the topside of the nozzle downstream of the transverse member and rearward of the distal end, and in fluid communication with the flow passage, and the distal end of the body member having a tapered point. In more preferred embodiments the nozzle includes separately or in combination the various features including a tubular and hollow member and a weighted tip member, the transverse member being positioned relatively close to the proximal end of the body member, within the first fifteen percent of the longitudinal length of the body member, a first and a second transverse member, both lying in substantially the same plane, and both positioned closer to the proximal end than the discharge orifice, a first and a second transverse member, both disposed on the proximal-end half of the body member, the body member being comprised of a tubular and hollow member and a weighted, distal-end tip member, the flow passage extending through the body member from the proximal end up to between about sixty-five and eighty-five percent of the overall longitudinal length of the body member, and having a cross-sectional area of between about one and about six square inches, the discharge orifice being a slot cut forward or backward through between about forty-five and about fifty percent of the circumferential surface of the body member at an angle of between about fifteen and forty-eight degrees from vertical, and the transverse member being comprised of a pair of substantially cylindrical arms, each having between about a three-fourths and one and one-half inch outside diameter. In preferred embodiment, with the angled-cut slot discharge orifice, the fan-shaped spray of fluid produced is upward and outward (either forward or backward) depending upon the cut of the slot.

The present invention is also a set of fluid-discharge nozzles as described, at least one of which provides a backward discharge and at least one of which comprises a forward discharge.

The present invention is also a method of discharging fluid employing a nozzle comprising (1) an elongate body member having a proximal and distal end, (2) at least one elongate transverse member affixed to the body member and extending normal from the body member sideways, (3) a flow passage within the body member extending from the proximal end to a closed end rearward of the distal end, (4) a discharge orifice positioned on the topside of the nozzle downstream of the transverse member and rearward of the distal end, and in fluid communication with the flow passage, and (5) the distal end of the body member having a tapered point, the method comprising the steps of:

(step 1) transporting the nozzle to the vicinity of the desired discharge;

(step 2) optionally inserting the nozzle, tapered point first, through an obstruction opening until at least the discharge orifice is through the opening; and (step 3) charging sufficient fluid under fluid pressure to the nozzle through the flow passage to effectuate a discharge of the fluid through the discharge orifice.

Among the preferred embodiments of the method, including the features of the descriptions above regarding use of the nozzle, the method also includes embodiments including, separately or in combination, (a) in step 2, partially inserting the nozzle through the obstruction opening, with the discharge orifice upward, and holding the proximal end of the nozzle by the arms of the traverse member, (b) in step 2, completely inserting the nozzle through the obstruction opening and delivering the nozzle to a surface past the obstruction opening in a discharge-orifice-upward position, (c) in step 3, charging sufficient fluid under fluid pressure to the nozzle through the flow passage to effectuate a backward discharge of the fluid through the discharge orifice while remaining on the opposite side of the obstruction opening, and (d) in step 3, charging sufficient fluid under fluid pressure to the nozzle through the flow passage to effectuate a forward discharge of the fluid through the discharge orifice while holding the nozzle by the transverse member.

It is well within the skill of a person in the technical field, upon becoming conversant with, or otherwise having knowledge of, the present invention, to select suitable combinations of features, dimensions and the like in view of the type of nozzle being designed and/or constructed.

The above described embodiments are exemplitive, and the terminology is employed for illustration purposes and not limitation purposes. The present invention is not limited to the combinations and subcombinations illustrated herein.

I claim:

1. A fluid-discharge nozzle comprising:

an elongate body member having a proximal and distal end;

at least one elongate transverse member affixed to said body member, extending normal from said body member sideways, and defining a topside and a bottom side, at least one of said topside and said bottom side being substantially unobstructed;

a flow passage within said body member extending from said proximal end to a closed end rearward of said distal end;

a discharge orifice positioned on said topside of said nozzle downstream of said transverse member and rearward of said distal end, and in fluid communication with said flow passage; and said distal end of said body member having a tapered point.

2. The fluid-discharge nozzle of claim 1, said body member being comprised of a tubular and hollow member and a weighted tip member.

3. The fluid-discharge nozzle of claim 1, said body member being between about fifteen and about thirty-five times as long as it is wide; and said body member being longer than said transverse member.

4. The fluid-discharge nozzle of claim 1, said transverse member having opposed free ends, and an overall length, measured between the tips of said opposed free ends, is between about thirty and sixty percent of the length of said body member.

5. The fluid-discharge nozzle of claim 1, said transverse member having opposed free ends, and an overall length, measured between the tips of said opposed free ends, is between about thirty-five and fifty percent of the length of said body member.

6. The fluid-discharge nozzle of claim 1, said transverse member being positioned relatively close to said proximal end of said body member, within the first fifteen percent of the longitudinal length of said body member.

7. The fluid-discharge nozzle of claim 1 including both a first and a second transverse member, both lying in substantially the same plane, and both positioned closer to said proximal end than said discharge orifice.

8. The fluid-discharge nozzle of claim 1 including both a first and a second transverse member, both disposed on the proximal-end half of said body member.

9. The fluid-discharge nozzle of claim 1, said body member being comprised of a tubular and hollow member and a weighted, distal-end tip member, between about thirty-five and seventy-five percent of the overall weight of said nozzle is within said tip member, and said tip member comprises between about fifteen and thirty-five percent of the overall longitudinal length of said body member.

10. The fluid-discharge nozzle of claim 1, said flow passage extending through said body member from said proximal end up to between about sixty-five and ninety percent of the overall longitudinal length of said body member, and having a cross-sectional area of between about one and about six square inches.

11. The fluid-discharge nozzle of claim 1, said discharge orifice being the sole discharge orifice and being a slot cut forward or backward through between about forty-five and about fifty percent of the circumferential surface of said body member at an angle of between about fifteen and forty-eight degrees from vertical.

12. The fluid-discharge nozzle of claim 1, said transverse member being comprised of a pair of substantially cylindrical arms, each having between about a three-fourths and one and one-half inch outside diameter.

13. A set of fluid-discharge nozzles comprising:

a first and second fluid-discharge nozzle each separately comprising:

an elongate body member having a proximal and distal end;

at least one elongate transverse member affixed to said body member, extending normal from said body member sideways, and defining a topside and a bottom side, at least one of said topside and said bottom side being substantially unobstructed;

a flow passage within said body member extending from said proximal end to a closed end rearward of said distal end;

a discharge orifice positioned on said topside of said nozzle downstream of said transverse member and rearward of said distal end, and in fluid communication with said flow passage; and said distal end of said body member having a tapered point, said discharge orifice of said first fluid-discharge nozzle being a slot cut forward through between about forty-five and about fifty percent of the circumferential surface of said body member at an angle of between about fifteen and forty-eight degrees from vertical for backward discharge, and said discharge orifice of said second fluid-discharge nozzle being a slot cut backward through between about forty-five and about fifty percent of the circumferential surface of said body member at an angle of between about fifteen and forty-eight degrees from vertical for forward discharge.

14. A method of discharging fluid employing a nozzle comprising (1) an elongate body member having a proximal and distal end, (2) at least one elongate transverse member affixed to said body member, extending normal from said body member sideways, and defining a topside and a bottom side, at least one of said topside and said bottom side being substantially unobstructed, (3) a flow passage within said body member extending from said proximal end to a closed end rearward of said distal end, (4) a discharge orifice positioned on said topside of said nozzle downstream of said transverse member and rearward of said distal end, and in fluid communication with said flow passage, and (5) said distal end of said body member having a tapered point, the method comprising the steps of:

(step 1) transporting said nozzle to the vicinity of the desired discharge;

(step 2) optionally inserting said nozzle, tapered point first, through an obstruction opening until at least said discharge orifice is through said opening; and (step 3) charging sufficient fluid under fluid pressure to said nozzle through said flow passage to effectuate a discharge of said fluid through said discharge orifice.

15. The method of claim 14 further including, in step 2, completely inserting said nozzle through said obstruction opening and delivering said nozzle to a surface past said obstruction opening in a discharge-orifice-upward position.

16. The method of claim 14, wherein said discharge orifice of said nozzle is a slot cut forward through between about forty-five and about fifty percent of the circumferential surface of said body member at an angle of between about fifteen and forty-eight degrees from vertical for forward discharge, further including, in step 2, completely inserting said nozzle through said obstruction opening and delivering said nozzle to a surface past said obstruction opening in a discharge-orifice-upward position, and in step 3, charging sufficient fluid under fluid pressure to said nozzle through said flow passage to effectuate a backward discharge of said fluid through said discharge orifice while remaining on the opposite side of said obstruction opening in a hands-off mode.

17. The method of claim 14, wherein said discharge orifice of said nozzle is a slot cut backward through between about forty-five and about fifty percent of the circumferential surface of said body member at an angle of between about fifteen and forty-eight degrees from vertical for forward discharge, further including, in step 3, charging sufficient fluid under fluid pressure to said nozzle through said flow passage to effectuate a forward discharge of said fluid through said discharge orifice while holding said nozzle by said transverse member.

18. The method of claim 14, wherein said discharge orifice of said nozzle is a slot cut forward or backward through between about forty-five and about fifty percent of the circumferential surface of said body member at an angle of between about fifteen and forty-eight degrees from vertical for forward discharge, and wherein said topside is substantially unobstructed, further including, in step 1, lowering said nozzle down the side of a tall building to a target window or target opening in the side of said building with said discharge orifice facing said building, said lowering being accomplished from a position at a level higher than said window or said opening with the nozzle, and said nozzle being released before or during said lowering, and in step 3, discharging fluid from said orifice into said building through said window or opening in a hands-off mode.

19. The method of claim 14 wherein said bottom side is substantially unobstructed, further including, in step 1, after transporting said nozzle to the vicinity of the desired discharge, delivering said nozzle to a surface at the vicinity of the desired discharge with said discharge orifice facing away from said surface, and releasing said nozzle, and in step 3, discharging fluid from said orifice in a hands-off mode.

* * * * *